US006413196B1

(12) United States Patent
Crowson

(10) Patent No.: US 6,413,196 B1
(45) Date of Patent: Jul. 2, 2002

(54) EXERCISING DEVICE

(76) Inventor: Joel L. Crowson, 5821 Caspiana, Bossier City, LA (US) 71112

( * ) Notice: Subject to any disclaimer, the term of this patent is extended or adjusted under 35 U.S.C. 154(b) by 0 days.

(21) Appl. No.: 09/560,759

(22) Filed: Apr. 28, 2000

Related U.S. Application Data

(60) Provisional application No. 60/131,500, filed on Apr. 29, 1999.

(51) Int. Cl.[7] ..... A63B 21/015

(52) U.S. Cl. ..... 482/118; 482/120; 473/445; 273/317

(58) Field of Search ..... 482/118, 129, 482/131, 133, 102, 103, 127, 125, 12, 20, 121, 124, 123; 473/415; 273/317.6, 317.7, 317.8, 317.9

(56) References Cited

U.S. PATENT DOCUMENTS

| | | | | | |
|---|---|---|---|---|---|
| 1,137,349 | A | * | 4/1915 | Patterson | 273/35 |
| 2,134,451 | A | | 10/1938 | McGrew | 272/57 |
| 2,455,707 | A | * | 12/1948 | Sheffer | 273/35 |
| 2,655,378 | A | * | 10/1953 | Sheffer | 273/35 |
| 2,848,234 | A | * | 8/1958 | Brandon | 273/35 |
| 3,083,016 | A | * | 3/1963 | Sumegi | 273/35 |
| 3,400,933 | A | * | 9/1968 | Heiser | 273/186 |
| 3,604,712 | A | * | 9/1971 | Prior et al. | 473/229 |
| 3,618,942 | A | | 11/1971 | Bates | 272/82 |
| 3,804,420 | A | * | 4/1974 | Boyd | 473/212 |
| 3,966,203 | A | * | 6/1976 | Bickford | 272/118 |
| 4,010,948 | A | | 3/1977 | Deluty | 272/133 |
| 4,135,714 | A | * | 1/1979 | Hughes | 272/136 |
| 4,174,832 | A | | 11/1979 | Thompson | 272/133 |
| 4,229,002 | A | * | 10/1980 | Masters | 482/94 |
| 4,243,219 | A | * | 1/1981 | Price | 482/103 |
| 4,600,190 | A | | 7/1986 | Berokoff | 272/136 |
| 4,974,836 | A | | 12/1990 | Hirsch | 272/117 |
| 5,072,934 | A | * | 12/1991 | Blanes | 482/94 |
| 5,082,262 | A | * | 1/1992 | Sanchez | 273/26 |
| 5,226,867 | A | | 7/1993 | Beal | 482/127 |
| 5,269,512 | A | | 12/1993 | Crowson | 273/26 R |
| 5,924,966 | A | * | 7/1999 | Havlovic | 482/129 |

OTHER PUBLICATIONS

B.F. Goodrich Brochure, "Torsilastic Springs—An Improved Device To Store and Release Controlled Mechanical Energy" 1986.

* cited by examiner

*Primary Examiner*—Michael A. Brown
*Assistant Examiner*—Lori Baker Amerson
(74) *Attorney, Agent, or Firm*—John M Harrison

(57) ABSTRACT

An exercising device for strengthening the muscles used in pitching or throwing a baseball or softball or swinging a baseball or softball bat. In a preferred embodiment the exercising device is characterized by a base and a vertical support post upward-standing from the base. A pulley housing is provided on the support post and a pulley and an eccentric cam wheel are rotatably mounted in the housing. A cam tensioning device is provided on the rear of the housing for exerting a preselected torsional resistance on the cam wheel and a torque cable connects the pulley and cam wheel, such that the cam wheel rotates with the pulley. A pull cable trained on the pulley extends through an opening provided in the pulley housing and a baseball, softball or the impact end of a bat is removably attached to the extending end of the pull cable. As the baseball or softball is grasped and pulled away from the pulley housing in a simulated pitching or throwing motion or the baseball bat swung away from the housing in a simulated batting motion, the pull cable exerts tension on the baseball, softball or bat, exercising the muscles used in pitching or throwing a softball or baseball or swinging a bat. As the pull cable is retracted into the pulley housing after the simulated pitching, throwing or batting motion is completed, the baseball, softball or bat returns to the original position and the motion is repeated.

13 Claims, 6 Drawing Sheets

EXERCISING DEVICE

CROSS-REFERENCE TO RELATED APPLICATIONS

This application claims the benefit of copending U.S. Provisional Application Ser. No. 60/131,500, filed Apr. 29, 1999.

BACKGROUND OF THE INVENTION

1. Field of the Invention

This invention relates to exercising devices and more particularly, to a portable exercising device for strengthening the muscles used in pitching or throwing a baseball or softball or swinging a baseball or softball bat. In a preferred embodiment the exercising device is characterized by a base, an upward-standing support post extending from the base and a rectangular pulley housing provided on the support post. A pulley and an eccentric cam wheel are rotatably mounted in the housing in adjacent relationship and a torque cable connects the pulley and the cam wheel such that the cam wheel rotates with the pulley. A spring-loaded cam tensioning device mounted on the rear of the housing exerts a preselected torsional resistance on the cam wheel and a pull cable which is trained on the pulley extends through an opening provided in the housing. A baseball, softball or the swinging end of a bat is removably attached to the extending end of the pull cable. As the user grasps and pulls the baseball or softball away from the housing in a simulated pitching or throwing motion or swings the bat away from the housing in a simulated batting motion, the pull cable is extended from the pulley and exerts tension on the baseball, softball or bat throughout the range of motion, strengthening the muscles used in pitching or throwing a baseball or softball or swinging a bat. After the pitching, throwing or swinging motion is completed, the pull cable is retracted into the housing and pulls the baseball, softball or bat to the original position, after which the simulated pitching, throwing or swinging motion is repeated.

One of the problems encountered by many amateur baseball or softball players in batting, throwing or pitching a softball or baseball, is inadequate muscle development or strength to achieve batting, throwing or pitching the softball or baseball with sufficient strength or speed. Batting and pitching or throwing practice is normally limited to batting, pitching or throwing the baseball or softball under simulated game conditions or in practice, without the use of tension or weights to develop muscles which are used in the pitching, throwing or batting motion. Accordingly, the exercising device of this invention is designed to apply a preselected tension to a bat, baseball or softball for exercising and strengthening the muscles used in throwing, pitching or batting a softball or baseball.

2. Description of the Prior Art

Numerous exercising devices are known in the art, typical of which is the "Exercising Device" described in U.S. Pat. No. 2,134,451, dated Oct. 25, 1938, to Norman Mogren. The Mogren device is characterized by a first pulley which is attached to a wall and one end of a support cable is attached to the support arm of the pulley. The support cable is suspended downwardly from the pulley support arm and the extending end of the support cable is looped around a second pulley to which is attached a sandbag, and trained around the first pulley and attached to a baseball bat or tennis racket. As the exerciser pulls the baseball bat or tennis racket away from the wall in a simulated batting or swinging motion, the sandbag exerts tension on the support cable and exercises the muscles involved in swinging a baseball bat or tennis racket. U.S. Pat. No. 3,618,942, dated Nov. 9, 1971, to Robert H. Bates, details "An Elastic Push-Pull Batting Practice Type Exercise Device" for exercising and strengthening the wrists of a baseball or softball batter. The device is characterized by a bat or club, an anchor board which is fastened to a wall or column and a length of strong, elastic rope or band attached at one end to the anchor board and at the other end to the bat or club. As the bat is gripped and repeatedly swung away from the anchor board in a simulated batting motion, the tension exerted on the bat by the elastic rope or band exercises the wrists of the batter. U.S. Pat. No. 4,010,948, dated March 8, 1977, to Michael E. Deluty, discloses a "Pull Type Friction Exercising Device" characterized by a housing which is attached to a stationary surface. A cord terminated by a hand grip can be extended from the housing against the adjustable internal resistance of the device. A spring-powered cord retractor reel rewinds the cord back into the housing when the extended cord is released. The cord runs from the retractor reel, around multiple capstans provided in the housing and then out of the housing. The internal resistance on the cord is preset with manually-operated push buttons which lock a selected number of the capstans, such that the capstans will not rotate in the unwind direction. The remaining capstans are permitted to rotate in the unwind direction. The push buttons can be set to produce a variety of cord resistance levels. A "Friction Type Exercise Device" is described in U.S. Pat. No. 4,174,832, dated Nov. 20, 1979, to Charles W. Thompson. The exercise device includes a housing and a cord wound on a recoil wheel contained in the housing. A handle is provided on the end of the cord for pulling the cord from the housing. Resistance is exerted on the cord by sliding friction between the cord and the housing and between the cord and a spool provided in the housing. The device includes independent adjustment for controlling the friction between the cord and the housing and between the cord and the spool. U.S. Pat. No. 4,243,219, dated Jan. 6, 1981, to Paul J. Price, discloses a "Portable Lean-To Exercising Device" including a weight frame which may be leaned against the top of a door frame for support. The weight frame supports a sliding weight sled or carriage, upon which is positioned a selected number of weights. A baseball or softball bat is attached to one end of a cord which is trained over a pulley provided at the top of the weight frame and the other end of the cord is attached to the carriage. As the baseball or softball bat is gripped and repeatedly moved in a simulated batting motion, the carriage is repeatedly pulled upwardly and lowered on the weight frame with the weights on the carriage exerting a constant selected tension on the cord and bat. U.S. Pat. No. 4,600,190, dated Jul. 15, 1986, to Andrew J. Berokoff, details an "Exercising Device" characterized by a hollow baseball or softball bat provided with an internal spring, to which is attached one end of a cable. The other end of the cable extends from an opening provided in the end of the bat and is attached to a wall or other stationary object. As the bat is swung in a simulated batting motion, the spring inside the bat increases the resistance on the cable and exercises the batter's arms. A "Resistance Weight Kit" is described in U.S. Pat. No. 4,974,836, dated Dec. 4, 1990, to David E. Hirsch. The resistance weight kit includes a support bar assembly having a rubber foot at either end and which may be friction-mounted in a doorframe. One end of a rope or cable is attached to the mounted support bar assembly and extends downwardly through a first pulley, from which is suspended a weight holder, and a selected number of weights is typically positioned on the weight holder. The rope or cable extends upwardly from the first pulley, through a second pulley suspended from the support bar assembly and a baseball, crossbar or ankle band attached to the end of the rope or cable is gripped and pulled to lift the weight holder and mounted weights from the floor and exercise the arms or legs of the user. U.S. Pat. No. 5,226,867, dated Jul. 13, 1993, to Daniel Beal, details an "Exercise Machine Utilizing Torsion Resistance" including individually operable and simultaneously adjustable right and left reel assemblies. Each reel assembly includes a reel and the reels of the right and left reel assemblies are connected by a belt. A spirally-wound spring applies to each reel a reactive torque of changing magnitude as the reel rotates in response to pulling a pull cord wound around one of the reels. My U.S. Pat. No. 5,269,512, dated Dec. 14, 1993, details a "Pitching and Batting Conditioning Device" characterized by single and multiple drum conditioning devices having a drum spool for receiving a weight line attached to a weight and one or more drums of the same or different diameters for receiving a conditioning line or lines attached to a baseball bat or ball. Conditioning of the arm or arms and upper body is achieved by grasping the bat or ball and swinging the bat or simulating throwing the ball against the resistance of the weight.

An object of this invention is to provide an exercising device for exercising muscles used in pitching or throwing a baseball or softball and swinging a baseball or softball bat.

Another object of this invention is to provide an exercising device characterized by a tensioned cable, to which is attached a baseball or softball bat, or a baseball or softball which is gripped by the user and repeatedly moved in a simulated swinging or throwing motion, respectively, against the tension exerted by the cable to strengthen or develop muscles used in swinging a baseball or softball bat or pitching or throwing a baseball or softball.

Still another object of this invention is to provide a free-standing, portable exercising device for exercising and strengthening or developing an athlete's arm and shoulder muscles used in swinging a baseball or softball bat or throwing or pitching a baseball or softball.

Yet another object of this invention is to provide an exercising device characterized by a housing having a pulley and an eccentric cam wheel rotatably mounted in the housing, a cam tensioning device provided on the housing for exerting torsional resistance on the cam wheel, a torque cable which connects the cam wheel and the pulley, such that the cam wheel rotates with the pulley and a pull cable which is trained around the pulley and extends from the housing, the extending end of which pull cable is attached to the swinging end portion of a softball or baseball bat or to a baseball or softball, to exert tension on the bat or ball as the bat or ball is gripped and repeatedly swung or thrown, respectively, against the bias exerted by the pull cable and facilitate exercising and strengthening or developing the muscles of the arms and shoulders used in swinging a bat or throwing or pitching a ball.

SUMMARY OF THE INVENTION

These and other objects of the invention are provided in a free-standing, portable exercising device for strengthening the muscles used in pitching or throwing a baseball or softball or swinging a baseball or softball bat. In a preferred embodiment the exercising device is characterized by a base having a vertical support post upward-standing from the base and a rectangular pulley housing provided on the support post. A pulley and an eccentric cam wheel are rotatably mounted in the housing in adjacent relationship and a torque cable connects the pulley and the cam wheel, such that the cam wheel rotates with the pulley. A spring-loaded cam tensioning device mounted on the rear of the housing exerts a preselected torsional resistance on the cam wheel and a pull cable, which is trained on the pulley extends through an opening provided in the housing. A baseball, softball or the swinging end of a bat is removably attached to the extending end of the pull cable. As the exerciser grasps and pulls the baseball or softball away from the housing in a simulated pitching or throwing motion, or swings the bat away from the housing in a simulated batting motion, the pull cable is extended from the pulley and the housing and exerts a constant tension on the baseball, softball or bat throughout the pitching, throwing or batting range of motion, thus strengthening and developing the muscles used in pitching or throwing a baseball or softball or swinging a bat. After the pitching, throwing or swinging motion is completed, the pull cable is retracted in the housing and pulls the baseball, softball or bat to the original position, wherein the simulated pitching, throwing or swinging motion is repeated.

BRIEF DESCRIPTION OF THE DRAWINGS

The invention will be better understood by reference to the accompanying drawings, wherein.

DESCRIPTION OF THE PREFERRED EMBODIMENTS

Figure 1:
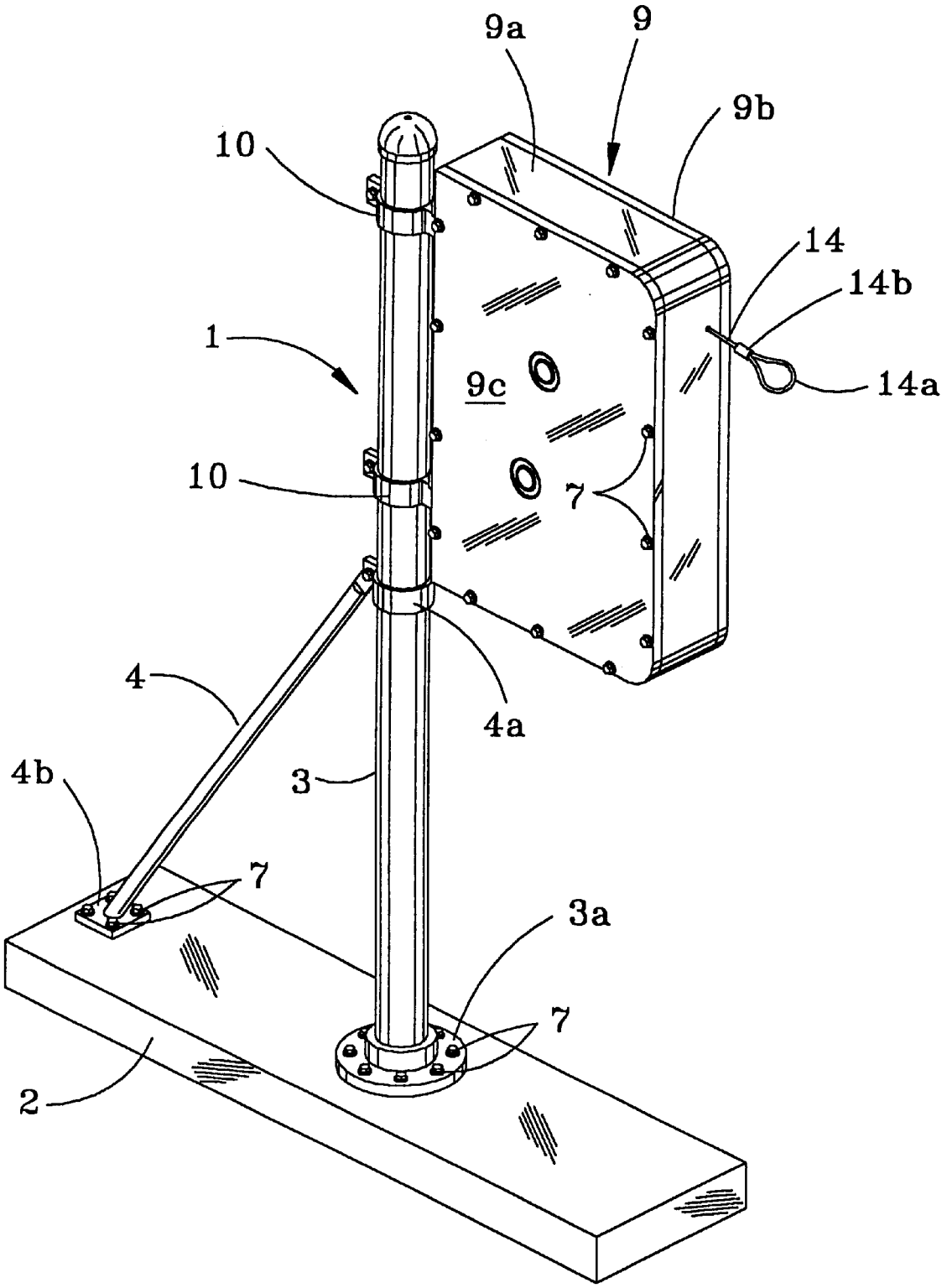
FIG. 1 is a front perspective view of a preferred embodiment of the exercising device of this invention.
Figure 2:
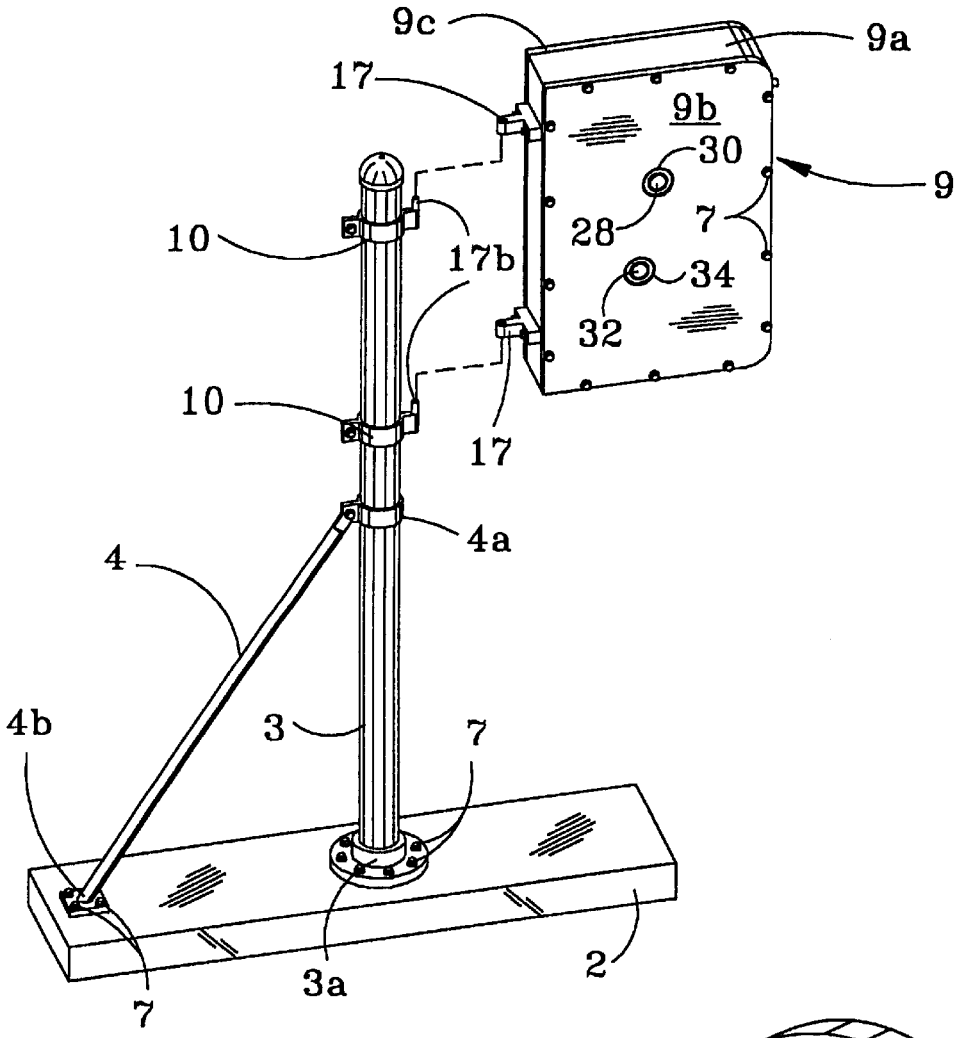
FIG. 2 is a front perspective view of the exercising device illustrated in FIG. 1, more particularly illustrating a preferred technique for securing the pulley housing component to the support post component of the device.
Figure 3:
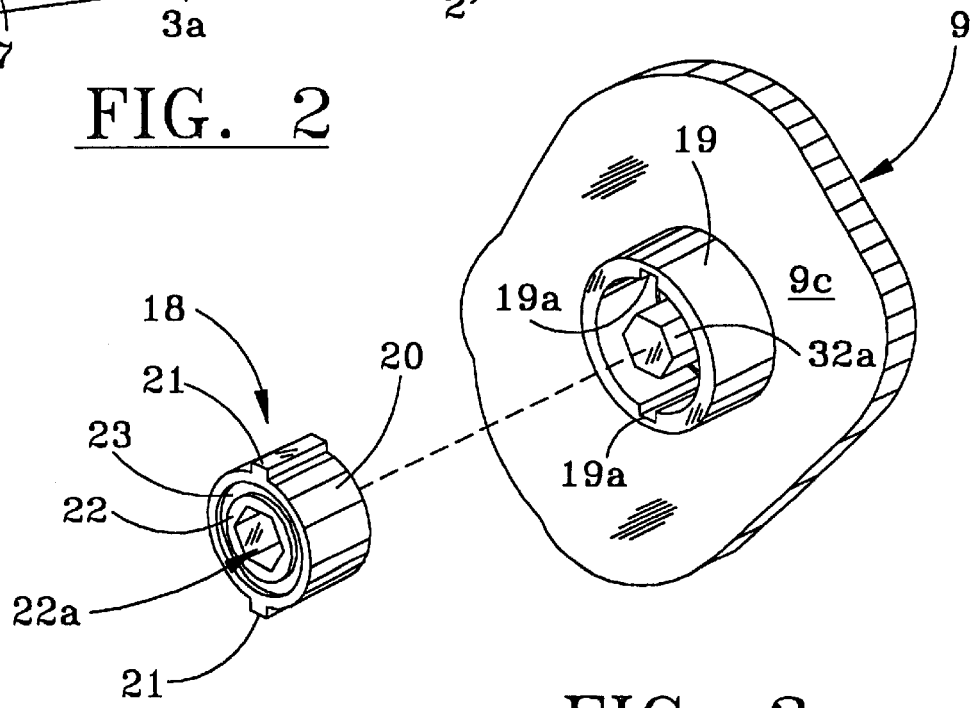
FIG. 3 is an exploded, perspective view of a typical cam tensioning device mounted on the pulley housing (shown partially in section) of the exercising device, more particularly illustrating typical mounting of the inner shell component of the cam tensioning device in the outer shell component of the cam tensioning device.
Figure 4:
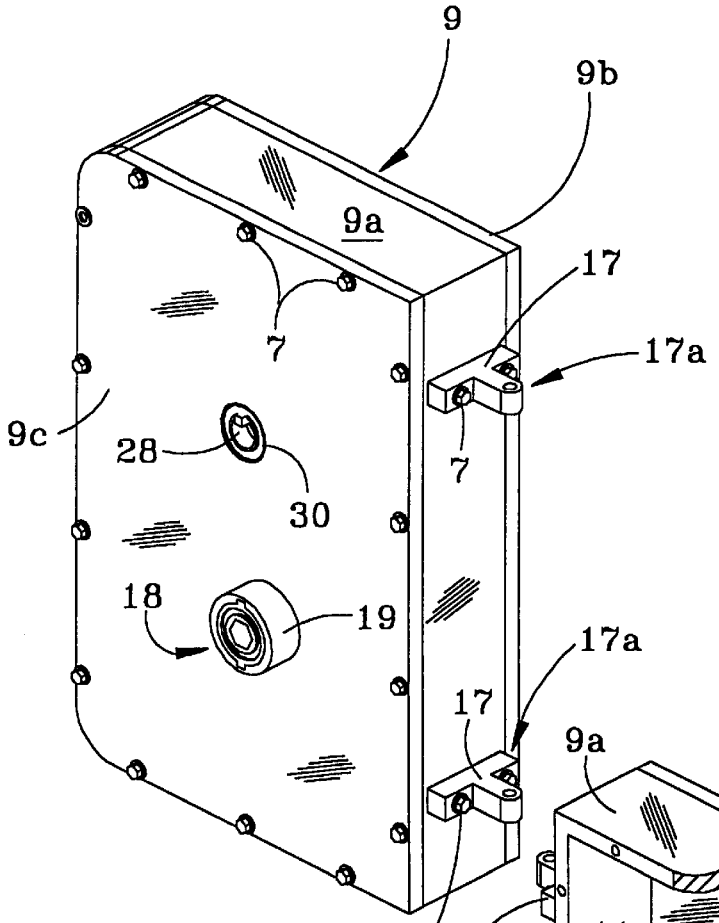
FIG. 4 is a rear perspective view of the pulley housing component of the exercising device, removed from the support post.

Referring initially to FIGS. 1–8 of the drawings, in a preferred embodiment the exercising device of this invention is generally illustrated by reference numeral 1. The exercising device 1 includes a typically elongated, wooden, rectangular base 2 and a support post 3 upward-standing from the base 2, the bottom end of which support post 3 is inserted in a flanged post mount collar 3*a,* secured to the base 2 typically by means of multiple mount bolts 7. The bottom end of an elongated, angled brace bar 4 is terminated by a brace mount flange 4*b,* secured to the base 2 in spaced apart relationship with respect to the post mount collar 3*a* by means of multiple mount bolts 7. The upper end of the brace bar 4 is typically bolted to a brace collar 4*a,* provided on the support post 3 above the post mount collar 3*a*. Two housing support collars 10 are mounted on the support post 3 in vertically-spaced relationship with respect to each other and as illustrated in FIGS. 1 and 2, a pulley housing 9 is mounted on the housing support collars 10, as hereinafter described. As particularly illustrated in FIG. 8, the pulley housing 9 is constructed from a substantially rectangular housing frame 9*a,* a front housing panel 9*b,* secured to one face of the housing frame 9*a,* typically by means of multiple mount bolts 7 and a rear housing panel 9*c,* typically bolted to the other face of the housing frame 9*a*. A pair of vertically-spaced housing flanges 17 are each typically bolted to the side of the housing frame 9*a* as illustrated in FIG. 4 and each housing flange 17 includes a flange bolt opening 17*a* which is positioned in registering relationship with respect to a corresponding collar bolt opening (not illustrated) provided in the corresponding housing support collar 10, as illustrated in FIG. 2. A flange mount bolt 17*b* (FIG. 2) is extended through the collar bolt opening of each housing support collar 10 and through the registering flange bolt opening 17*a* of the corresponding housing flange 17, and threadably receives a nut (not illustrated) for securing the pulley housing 9 on the housing support collars 10.

Figure 8:
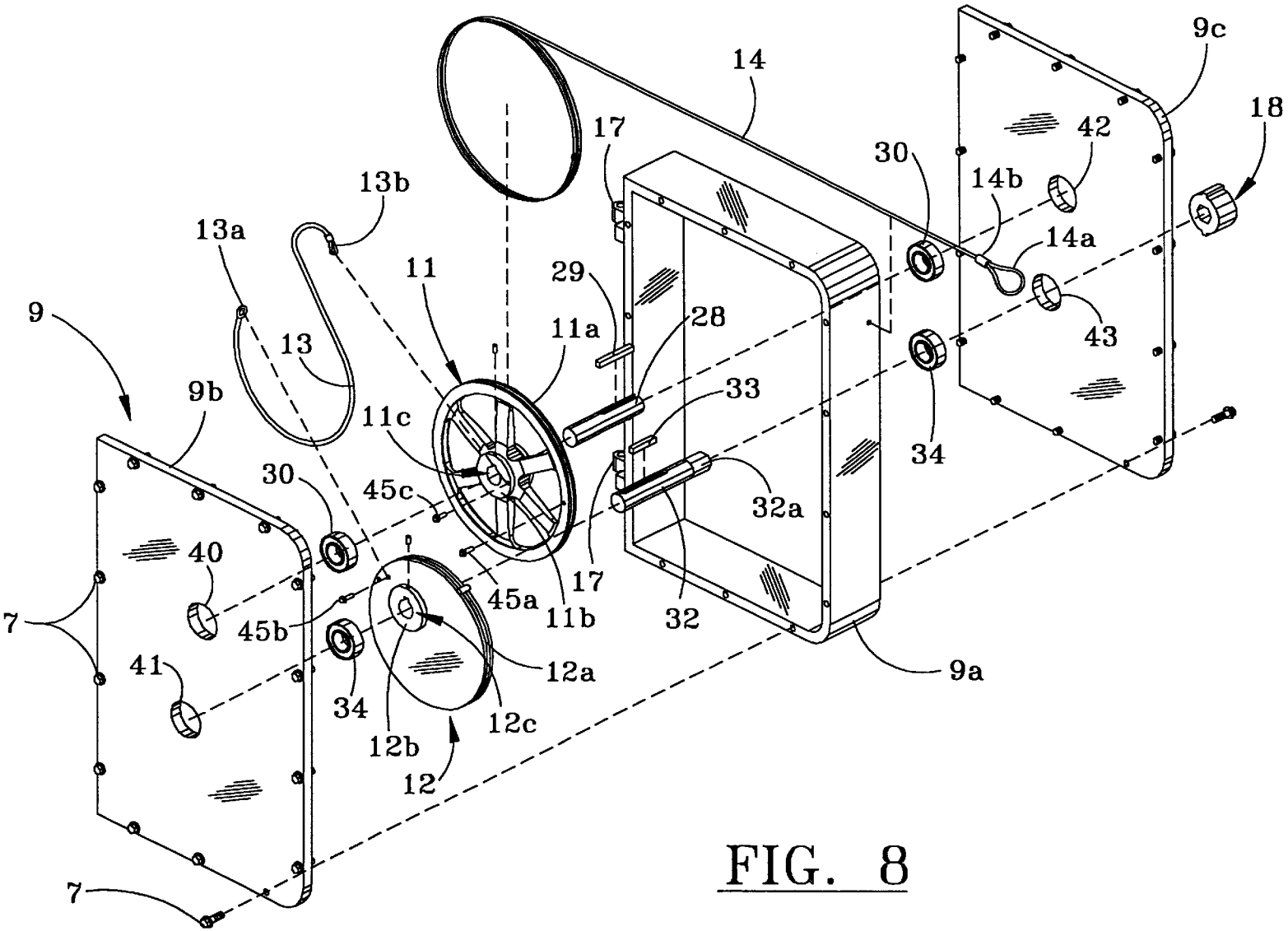
FIG. 8 is an exploded, perspective view of the pulley housing and pulley, cam wheel, tensioning cable, pull cable and cam tensioning device components of the exercising device.

As further illustrated in FIG. 8, a front pulley shaft opening 40 is provided in the front housing panel 9*b* and a front cam shaft opening 41 is provided in the front housing panel 9*b* beneath and in slightly offset relationship with respect to the front pulley shaft opening 40, the purpose of which front pulley shaft opening 40 and front cam shaft opening 41 will be hereinafter further described. A rear pulley shaft opening 42 and a rear cam shaft opening 43 are provided in the rear housing panel 9*c,* in registering relationship with respect to the front pulley shaft opening 40 and the front cam shaft opening 41, respectively, for purposes which will also be hereinafter further described. An annular pulley shaft collar 30 is fixedly inserted in the front pulley shaft opening 40 and the rear pulley shaft opening 42, respectively, and an annular cam shaft collar 34 is likewise fixedly inserted in the front cam shaft opening 41 and the rear cam shaft opening 43, respectively. An annular pulley 11, provided with a circumferential cable groove 11*a* and a pulley hub 11*b* having a central hub opening 11*c,* is located in the pulley housing 9. An elongated, cylindrical pulley shaft 28 extends through the central hub opening 11*c* of the pulley hub 11*b* and the ends of the pulley shaft 28 are rotatably mounted in the respective pulley shaft collars 30 (fitted in the front pulley shaft opening 40 of the front housing panel 9*b* and the rear pulley shaft opening 42 of the rear housing panel 9*c,* respectively). The pulley 11 is keyed to the pulley shaft 28 by means of a pulley shaft key 29, conventionally fitted in aligned key slots provided in the pulley shaft 28 and the pulley hub 11*b,* respectively, to facilitate rotation of the pulley shaft 28 with the pulley 11 in the respective pulley shaft collars 30, as hereinafter further described. A cam wheel 12, having a cable groove 12*a* shaped in the circumference thereof and provided with an eccentric cam wheel hub 12*b* having a cam shaft opening 12*c,* is also provided in the pulley housing 9 adjacent to the pulley 11. An elongated cam wheel shaft 32 extends through the cam shaft opening 12*c* and one end of the cam wheel shaft 32 is rotatably mounted in the cam shaft collar 34 (seated in the front cam shaft opening 41) and the other end of the cam wheel shaft 32 extends through the cam shaft collar 34 (seated in the rear cam shaft opening 43), and terminates in a hex shaft end 32*a* which extends beyond the plane of the rear housing panel 9*c* for purposes which will be hereinafter further described. The cam wheel 12 is keyed to the cam wheel shaft 32 by means of a cam shaft key 33, fitted in aligned key slots shaped in the cam wheel shaft 32 and cam wheel hub 12*b,* respectively, to facilitate rotation of the cam wheel 12 with the cam wheel shaft 32, as hereinafter described.

Figure 5:
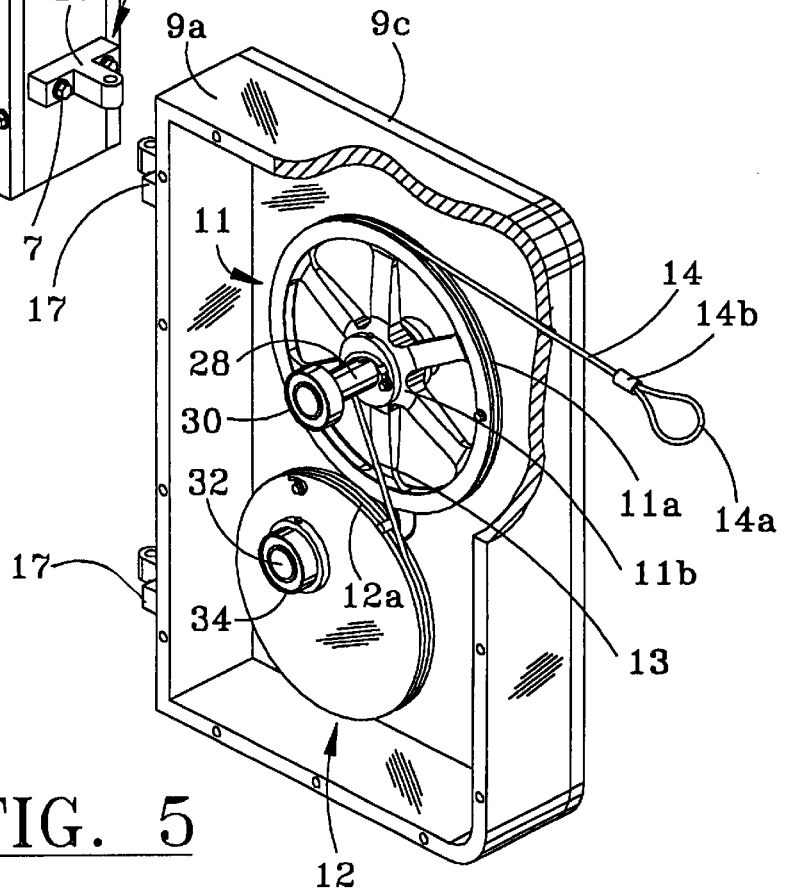
FIG. 5 is a perspective view, partially in section, of the pulley housing component of the exercising device, with the front panel of the housing removed and more particularly illustrating the pulley and cam wheel components of the device, rotatably mounted in the housing.
Figures 6, 7:
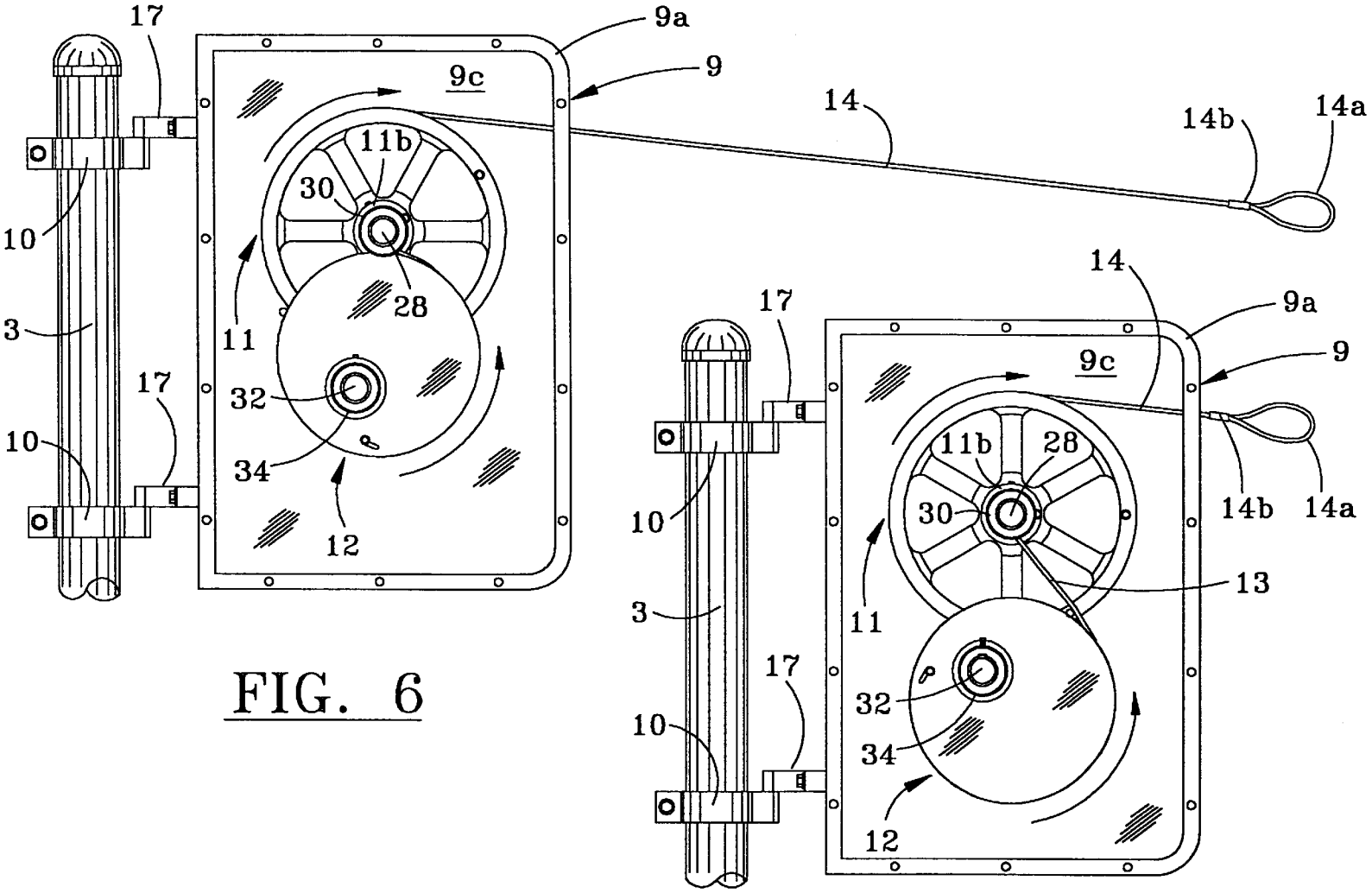
FIG. 6 is a front view of the pulley housing with the front panel of the housing removed and illustrating relative positions of the pulley and tensioned cam wheel after the pull cable component of the device has been fully extended from the housing.
FIG. 7 is a front view of the pulley housing of the exercising device illustrated in FIG. 6, illustrating relative positions of the pulley and tensioned cam wheel as the pull cable is initially extended from the housing.

Referring again to FIGS. 5–8 of the drawings, one end of a pull cable 14 is secured to the pulley 11 by means of a first cable screw 45*a,* as particularly illustrated in FIG. 8 and the pull cable 14 is normally seated in the circumferential cable groove 11*a* of the pulley 11. The extending end of the pull cable 14 terminates in a cable loop 14*a,* typically secured by a cable stay 14*b,* to facilitate attachment of a baseball or softball bat 25 (FIG. 9) or a baseball or softball (not illustrated) to the pull cable 14, as hereinafter further described. As illustrated in FIG. 5, the cable loop 14*a* end of the pull cable 14 extends from the housing 9 through a cable opening (not illustrated) provided in the housing frame 9*a* of the housing 9. As illustrated in FIGS. 5 and 8, a torque cable 13 connects the pulley 11 to the cam wheel 12 in such a manner that as the pulley 11 is rotated in a clockwise direction in the pulley housing 9 by extending the pull cable 14 from the pulley housing 9, as hereinafter further described, the cam wheel 12 rotates in a counterclockwise direction, as illustrated in FIGS. 6 and 7. A first cable loop 13*a,* provided on one end of the torque cable 13 as illustrated in FIG. 8, is secured to the cam wheel 12 by means of a second cable screw 45*b,* extended through the first cable loop 13*a* and threaded into the cam wheel 12. The torque cable 13 is normally seated in that segment of the cable groove 12*a* which runs along the bottom portion of the cam wheel 12, as illustrated in FIG. 5, and terminates in a second cable loop 13*b,* secured on the pulley hub 11*b* of the pulley 11 by means of a third cable screw 45*c* as further illustrated in FIG. 8.

Referring again to FIGS. 3 and 6–8 of the drawings, a typical cam tensioning device 18, particularly that sold by the BF Goodrich Corp. under the trademark TORSILASTIC spring, includes a substantially cylindrical outer shell 19, fixedly mounted on the exterior surface of the rear housing panel 9*c* in concentric relationship with respect to the rear cam shaft opening 43 (through which the hex shaft end 32*a* of the cam wheel shaft 32 extends), as illustrated in FIG. 8. A pair of diametrically-opposed flange slots 19*a* are provided in the inner surface of the outer shell 19, for receiving respective shell flanges 21 provided on a substantially cylindrical inner shell 20 which is fitted inside the outer shell 19, as illustrated in FIG. 3. The outer surface (not illustrated) of a rubber, cylindrical torsion spring 23 is bonded to the inner surface (not illustrated) of the inner shell 20, and the outer surface (also not illustrated) of a cylindrical socket shaft 22 is bonded to the inner surface (not illustrated) of the torsion spring 23. As further illustrated in FIG. 3, a hex socket 22*a* extends through the socket shaft 22 for receiving the companion hex shaft end 32*a* of the cam wheel shaft 32. Accordingly, as the pull cable 14 is extended from the housing 9, and the pulley 11 rotated in the clockwise direction and the cam wheel 12 rotated in the counterclockwise direction by operation of the torque cable 13, as illustrated in FIGS. 6 and 7 and hereinafter further described, the hex shaft end 32*a* of the cam wheel shaft 32, inserted in the hex socket 22*a* of the socket shaft 22, rotates the socket shaft 22 against torsional resistance exerted by the fixed torsion spring 23. This effect occurs as the inner shell 20, to which the torsion spring 23 is bonded, is locked in the stationary outer shell 19 by operation of the shell flanges 21 in the flange slots 19*a*. The torsional resistance exerted by the torsion spring 23 on the hex shaft end 32*a* of the cam wheel shaft 32 is transmitted to the cam wheel 12, pulley 11 and extended pull cable 14. After the pull cable 14 has been extended from the housing 9 and extension pressure on the pull cable 14 is released, continued torsional resistance exerted by the torsion spring 23 on the cam wheel shaft 32 rotates the cam wheel 12 in the clockwise direction and the pulley 11 in the counterclockwise direction, and retracts the pull cable 14 into the housing 9 until the torsion spring 23 returns to the non-stressed configuration.

Figure 10:
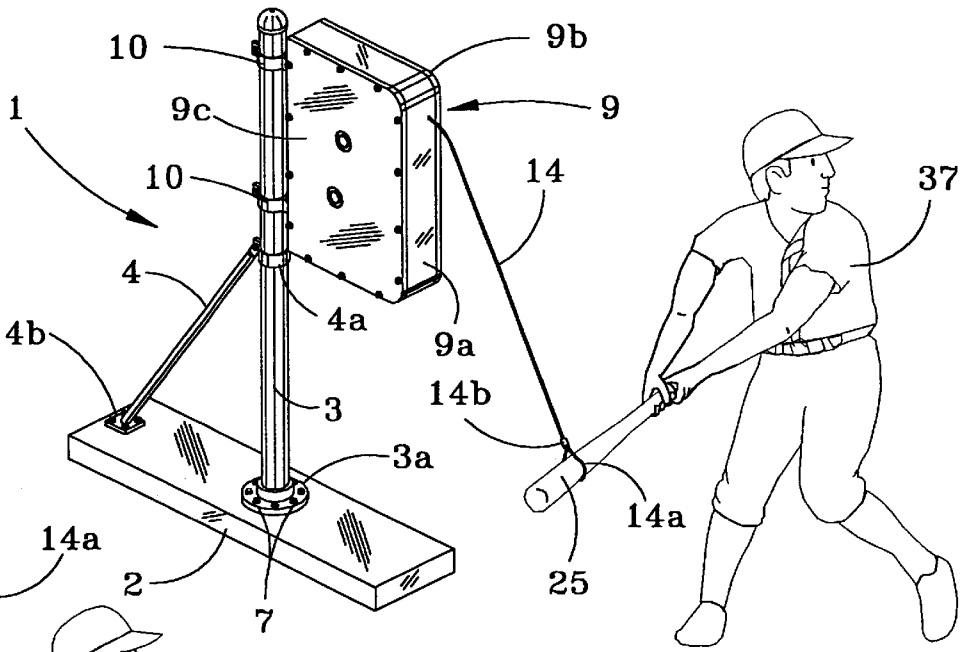
FIG. 10 is a perspective view of the exercising device illustrated in FIG. 9, illustrating full extension of the pull cable from the pulley housing as the exerciser swings the bat against tension exerted by the pull cable in performing a bat swinging exercise.
Figure 9:
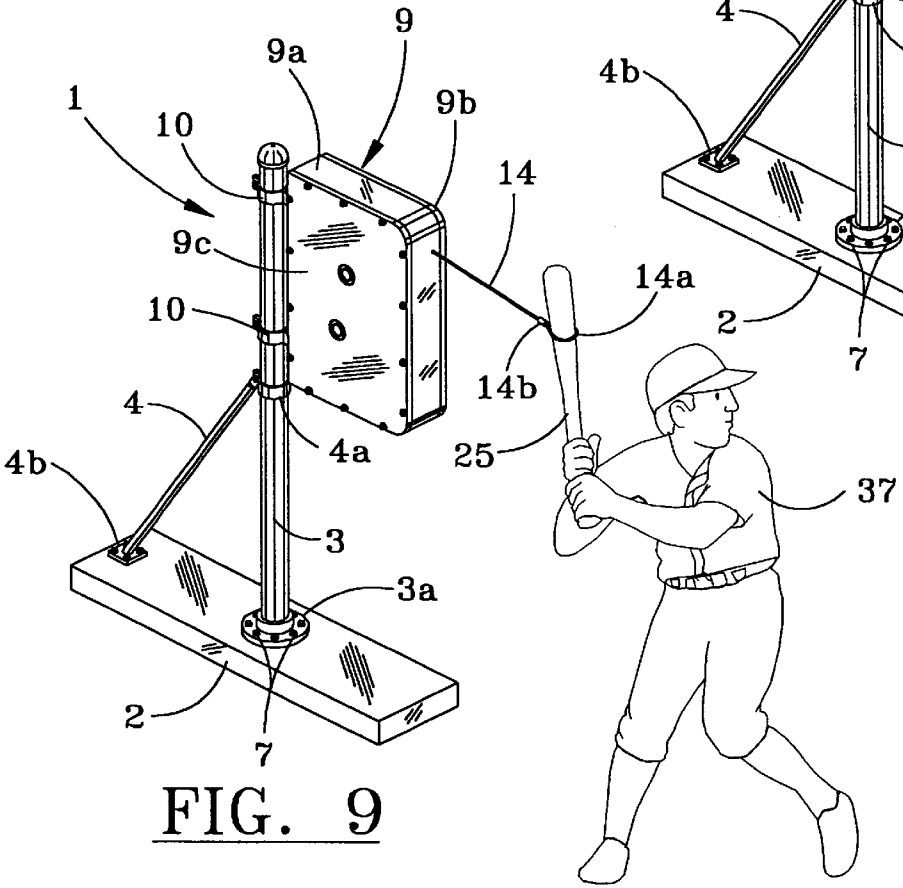
FIG. 9 is a perspective view of the exercising device, more particularly illustrating a baseball or softball bat attached to the pull cable component of the device and an exerciser gripping and positioning the bat preparatory to performing a bat swinging exercise.

Referring again to FIGS. 6 and 7 and to FIGS. 9 and 10 of the drawings, in typical application of the exercising device 1 of this invention, a baseball or softball bat 25 is initially extended through the cable loop 14*a* provided on the end of the pull cable 14. Alternatively, the cable loop 14*a* can be attached to an eye bolt (not illustrated) threaded into the bat 25. A user 37 then grips the bat 25 and as the user 37 swings the bat 25 in a simulated batting swing away from the pulley housing 9, as illustrated in FIG. 10, the pull cable 14 is extended from the pulley housing 9 with the cam tensioning device 18 exerting tension on the rotating cam wheel 12 and pulley 11, pull cable 14 and bat 25, as heretofore described. After the swinging motion is completed, the user 37 releases swinging pressure exerted on the bat 25 and the tensioned cam tensioning device 18 exerts torsional pressure on the cam wheel shaft 32, cam wheel 12 and pulley 11, causing retraction of the pull cable 14 into the housing 9 and the pull cable 14 pulls the bat 25 to the original, pre-swing position. The swinging motion of the bat 25 is then repeated as desired, to facilitate exercising the arm and shoulder muscles used in swinging a baseball or softball bat. To facilitate exercising muscles involved in throwing or pitching a softball or baseball (not illustrated), the softball or baseball can be attached to the pull cable 14, typically by threading an eye bolt (not illustrated) into the softball or baseball and hooking the cable loop 14*a* onto the eye bolt. The user 37 grips and repeatedly pulls the baseball or softball away from the housing 9 in a simulated throwing or pitching motion to exercise the arm and shoulder muscles used in throwing or pitching the softball or baseball.

It will be appreciated by those skilled in the art that the exercising device of this invention is designed to apply tension to a cable attached to a bat or ball and strengthen the pitching, throwing and batting muscles of a user. The exercising device is lightweight, free-standing and portable and does not require attachment to a floor or other surface for use. It is understood that the tensioning device 18 described above with respect to FIGS. 3 and 8 and having a given torsional resistance can be selected according to the desired tension to be applied to the extended pull cable 14. Moreover, any of a variety of tensioning devices 18 other than that described above with respect to FIGS. 3 and 8 can be used to apply a preselected torsion to the cam wheel shaft 32 and tension on the pull cable 14 and attached bat, softball or baseball, according to the knowledge of those skilled in the art.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An exercising device comprising a support; a pulley rotatably mounted on said support; a tensioning device for exerting tension on said pulley, said tensioning device including an outer shell fixedly attached to said support, an inner shell provided in said outer shell in fixed relationship to said outer shell a torsion spring in said inner shell and fixedly engaging said inner shell, and a socket shaft provided in said torsion spring and operable engaging said pulley: and a pull cable engaging said pulley, whereby said tensioning device exerts tension on said pulley and said tension is transmitted from said pulley to said pull cable as said pull cable is extended from said pulley.

2. The exercising device of claim 1 wherein said support comprises a pulley housing and said pulley is rotatably mounted in said pulley housing.

3. The exercising device of claim 1 comprising a base for resting on a supporting surface and a vertical support post extending from said base, and wherein said support is provided on said support post.

4. The exercising device of claim 1 wherein said support comprises a pulley housing and said pulley is rotatably mounted in said pulley housing, and comprising a base for resting on a supporting surface and a vertical support post extending from said base, and wherein said pulley housing is provided on said support post.

5. The exercising device of claim 1 comprising a cam wheel rotatably mounted on said support and operatively engaging said pulley for rotation with said pulley, and wherein said socket shaft of said tensioning device operatively engages said cam wheel for exerting torsion on said cam wheel.

6. The exercising device of claim 5 wherein said support comprises a pulley housing and said pulley and said cam wheel are rotatably mounted in said pulley housing.

7. The exercising device of claim 5 comprising a base for resting on a supporting surface and a vertical support post upward-standing from said base, and wherein said support is provided on said support post.

8. The exercising device of claim 5 wherein said support comprises a pulley housing and said pulley and said cam wheel are rotatably mounted in said pulley housing, and comprising a base for resting on a supporting surface and a vertical support post upward-standing from said base, and wherein said pulley housing is provided on said support post.

9. An exercising device for exercising the arm of a baseball or softball pitcher or batter, said exercising device comprising a support; a cam wheel rotatably mounted on said support and a cam tensioning device operatively engaging said cam wheel for exerting torsion on said cam wheel; a pulley rotatably mounted on said support and a torque cable connecting said cam wheel with said pulley, whereby said cam wheel rotates with said pulley; and a pull cable engaging said pulley, whereby said torsion is transmitted from said cam wheel to said pull cable as said pull cable is extended from said pulley.

10. The exercising device of claim 9 wherein said support comprises a pulley housing, and said pulley and said cam wheel are rotatably mounted in said pulley housing.

11. The exercising device of claim 9 comprising a base for resting on a supporting surface and a support post upward-standing from said base, and wherein said support is provided on said support post.

12. The exercising device of claim 9 wherein said support comprises a pulley housing and said pulley and said cam wheel are rotatably mounted in said pulley housing, and comprising a base for resting on a supporting surface and a support post upward-standing from said base, and wherein said pulley housing is provided on said support post.

13. An exercising device for exercising an arm of a baseball or softball batter or pitcher, said exercising device comprising a base for resting on a supporting surface; a support post upward-standing from said base; a pulley housing provided on said base; a cam wheel shaft rotatably mounted in said housing and an eccentric cam wheel provided on said cam wheel shaft; a cam tensioning device provided on said pulley housing and operatively engaging said cam wheel shaft for applying torsion to said cam wheel said cam tensioning device comprising an outer shell fixedly attached to said pulley housing an inner shell provided in said outer shell in fixed relationship to said outer shell, a torsion spring provide in said inner shell and fixedly engaging said inner shell and a socket shaft provided in said torsion spring and engaging said cam shaft and fixedly engaging said torsion spring; a pulley shaft rotatably mounted in said housing adjacent to said cam wheel shaft and a pulley provided on said pulley shaft; and a torque cable connecting said cam wheel and said pulley, whereby said cam wheel rotates with said pulley; and a pull cable engaging said pulley, whereby said torsion is transmitted from said cam wheel to said pull cable as said pull cable is extended from said pulley.

* * * * *